US007194872B2

(12) United States Patent
Kim et al.

(10) Patent No.: US 7,194,872 B2
(45) Date of Patent: Mar. 27, 2007

(54) DISPENSER FOR REFRIGERATOR

(75) Inventors: Ill Shin Kim, Changwon-shi (KR); Si Yeon An, Changwon-shi (KR); Chang Hwan Seo, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 65 days.

(21) Appl. No.: 10/495,274

(22) PCT Filed: Sep. 10, 2002

(86) PCT No.: PCT/KR02/01701

§ 371 (c)(1),
(2), (4) Date: Oct. 22, 2004

(87) PCT Pub. No.: WO03/033976

PCT Pub. Date: Apr. 24, 2003

(65) Prior Publication Data

US 2005/0039482 A1 Feb. 24, 2005

(30) Foreign Application Priority Data

Oct. 16, 2001 (KR) ..... 2001-63641

(51) Int. Cl.
*B60H 1/32* (2006.01)

(52) U.S. Cl. ..... 62/338; 62/389; 222/146.6

(58) Field of Classification Search ..... 62/337–339, 62/389–400; 222/146.6
See application file for complete search history.

(56) References Cited

U.S. PATENT DOCUMENTS 2,126,491 A * 8/1938 McCartha ..... 222/182
2,408,704 A * 10/1946 Taylor ..... 222/160
2,512,395 A * 6/1950 Sundberg ..... 222/182
3,429,140 A * 2/1969 White ..... 62/339
3,834,178 A * 9/1974 Pink ..... 62/338
3,934,758 A * 1/1976 Kipp ..... 222/108
4,610,375 A 9/1986 Germi et al.
4,970,871 A * 11/1990 Rudick ..... 62/187
5,096,095 A 3/1992 Burton ..... 222/173
5,359,795 A 11/1994 Mawby et al.
5,603,230 A 2/1997 Tsai ..... 62/390
5,787,724 A 8/1998 Pohl et al. ..... 62/389
5,971,213 A 10/1999 Lee ..... 222/146.6
6,276,146 B1 8/2001 Kim et al. ..... 62/66

FOREIGN PATENT DOCUMENTS

CN 1212356 3/1999

* cited by examiner

*Primary Examiner*—William E. Tapolcai
(74) *Attorney, Agent, or Firm*—Ked & Associates, LLP

(57) ABSTRACT

A dispenser for a refrigerator is disclosed, which enables an effective usage of the inner space of the refrigerator and enables to always provide fresh water to a user. The dispenser includes a first pipe connected with a water supply source; a reservoir installed inside a door of the refrigerator and connected with the first pipe, for temporarily storing water supplied from the water supply source; a second pipe connected with the reservoir; and a discharging part installed in the door of the refrigerator and connected with the second pipe, for discharging part installed in the door of the refrigerator and connected with the second pipe, for discharging the water supplied from the reservoir depending on a user's necessity.

24 Claims, 3 Drawing Sheets

DISPENSER FOR REFRIGERATOR

TECHNICAL FIELD

The present invention relates to a refrigerator, and more particularly, to a dispenser for a refrigerator, which is installed inside the refrigerator to provide a user with drinking water.

BACKGROUND ART

First, a general refrigerator and a dispenser installed therein will be described with reference to FIG. 1.

As shown in FIG. 1, water supplied from a water supply source such as a tap is filtrated at a filtration unit 1 through a pipe Pa, and then is supplied to a valve 2 connected to the filtration unit 1.

The valve 2 has two discharging holes through which water is selectively blown. One discharging hole of the valve 2 supplies water to an ice machine 6 through a pipe Pc, and the other discharging hole supplies water to a reservoir 3 through a pipe Pd. Accordingly, a constant level of water is always stored in the reservoir 3, and it can be supplied to a discharging part 5 through a pipe Pe. Here, the reservoir 3 is generally installed inside the cold-storage room so as to cool the stored water, and the discharging part 5 is installed, for instance, in front of a door 4 (ex, the door of the freezer). This dispenser allows a user to be given fresh water from the refrigerator.

This general refrigerator, however, has the following drawbacks.

Since the reservoir 3 is installed inside the cold-storage room, usage space inside the cold-storage room substantially decreases as much.

Also, since the reservoir 3 and the discharging part 5 are separated from each other, the pipe P3 connected between them should be extended long, and a part of the pipe P3 is indispensably placed outside the refrigerator. Accordingly, temperature of the water stored in that portion is substantially the same as that of the outside air in that portion that is higher than the temperature of the interior of the cold-storage room. As a result, if a user discharges water through the discharging part 5 at an initial stage, the water stored in a part of the pipe Pe at the room temperature is discharged instead of cold water stored in the reservoir 3.

DISCLOSURE OF THE INVENTION

Accordingly, the present invention is directed to a dispenser for a refrigerator that substantially obviates one or more of the problems due to limitations and disadvantages of the related art.

An object of the present invention is to provide a refrigerator and a dispenser for a refrigerator in which the inner space of the refrigerator does not decrease.

Another object of the present invention is to provide a refrigerator and a dispenser for a refrigerator capable of directly discharging cold water.

Additional features and advantages of the invention will be set forth in the description which follows, and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, there is provided a dispenser for a refrigerator. The dispenser includes: a first pipe connected with a water supply source; a reservoir installed inside a door of the refrigerator and connected with the first pipe, for temporarily storing water supplied from the water supply source; a second pipe connected with the reservoir; and a discharging part installed in the door of the refrigerator and connected with the second pipe, for discharging the water supplied from the reservoir depending on a user's necessity.

The reservoir is installed inside a door of a freezer, preferably, the reservoir is buried in an adiabatic material layer disposed within the door of the freezer, and more preferably, the reservoir is installed in the vicinity of the front side of the door of the freezer.

Alternatively, the reservoir is installed in the vicinity of the discharging part, and preferably installed right after the discharging part.

The discharging part is installed in a door of a freezer of the refrigerator, and preferably installed right before the reservoir.

Also, the second pipe is installed inside a door of a freezer of the refrigerator and is buried in an adiabatic material layer, and preferably installed in the vicinity of the front side of the door of the freezer.

Likewise, the first pipe is partially installed inside a door of a freezer of the refrigerator and is buried in an adiabatic material layer, and preferably partially installed in the vicinity of the front side of the door of the freezer.

According to the aforementioned present invention, the reservoir is installed inside the door, thereby enhancing the efficiency in use of the inner space of a refrigerator, and providing convenience in that the water discharged from the reservoir is always supplied at a cold status.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

BEST MODE FOR CARRYING OUT THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 2:
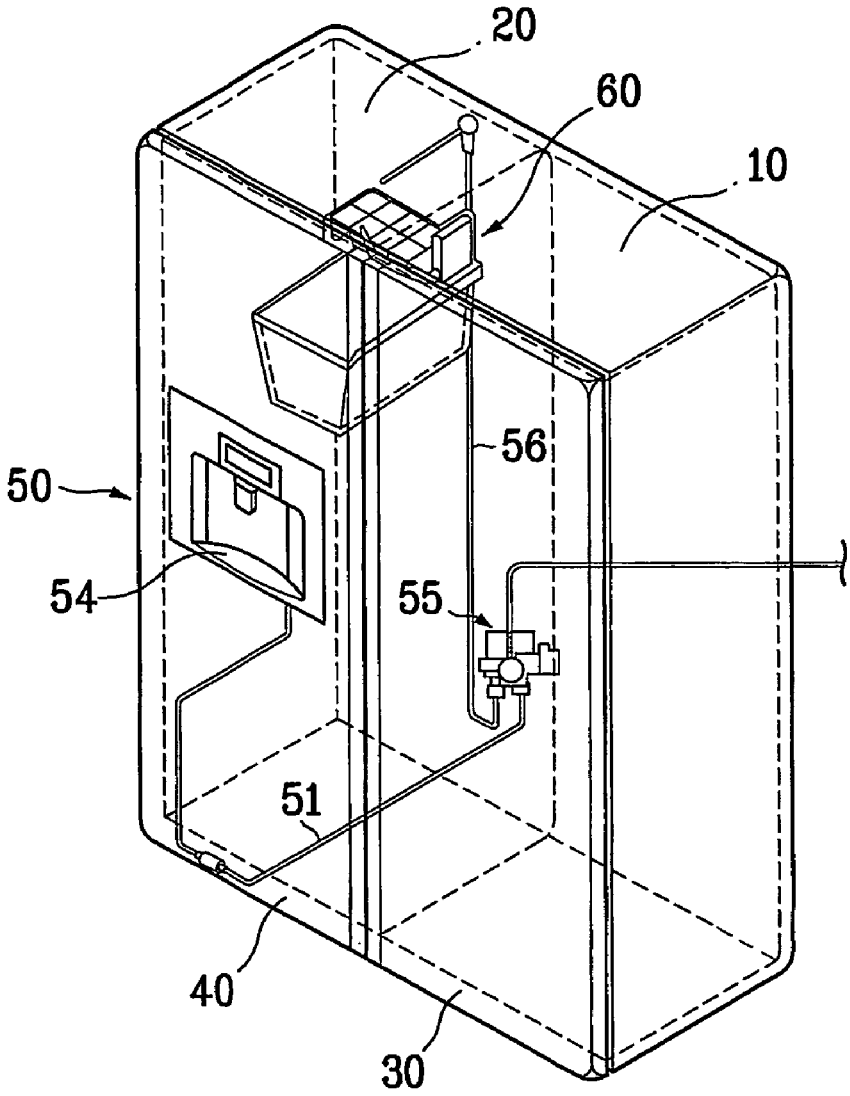
FIG. 2 is a perspective view schematically showing a refrigerator according to the present invention.
Figure 3:
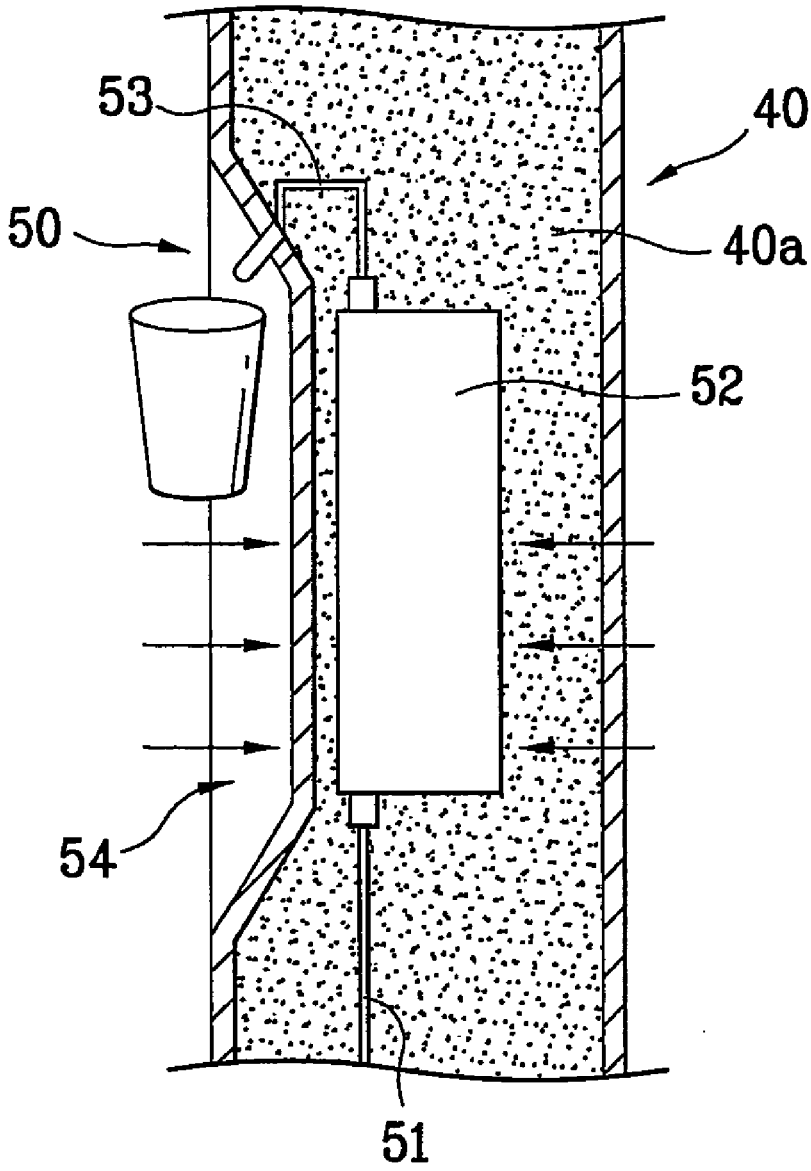
FIG. 3 is a longitudinal sectional view of a door in which a dispenser according to the present invention is installed.

FIG. 2 is a perspective view schematically showing a refrigerator according to the present invention, and FIG. 3 is a longitudinal sectional view of a door in which a dispenser according to the present invention is installed.

As shown in FIGS. 2 and 3, a refrigerator of the present invention basically includes cold-storage room and freezer 10 and 20 formed inside a main body, and cold-storage room door 30 and freezer door 40. Also, the refrigerator may further include disperser 50 and ice machine 60 for the purpose of providing an additional function, e.g., for providing drinking water or ice.

Here, since the cold-storage room/freezer 10/20, the doors 30 and 40, and the ice machine 60 are the same in construction as those of the general refrigerator, their description is omitted, and only the dispenser is described in more detail.

The dispenser 60 according to the present invention includes a supply part for supplying drinking water from a water supply source to the interior of the refrigerator, and a discharging part 54 discharging the supplied water from the supply part according to a user's need.

The supply part includes a first pipe 51 connected with the water supply source, a reservoir 52 connected with the first pipe 51, and a second pipe 53 connecting the reservoir 52 and the discharging part 54. Also, in case the ice machine 60 is installed at the refrigerator, a valve 55 for controlling water supply is installed on the first pipe 51, and a third pipe 56 is branched from the valve 55 and extended to the ice machine 60 so as to supply water to the ice machine 60.

In more detail, the reservoir 52 plays a role in temporarily storing the water supplied through the first pipe 51. Preferably, the reservoir 52 is, as shown in FIG. 3, disposed not at the cold-storage room but at the interior of the doors 20 and 30 of the refrigerator. Accordingly, when compared with the conventional refrigerator, the inner space of the refrigerator, e.g., the cold-storage room of the invention does not decrease unnecessarily. Meanwhile, since the reservoir 52 is located inside the doors 30 and 40, the drinking water in the reservoir 52 is indirectly cooled differently from that in the conventional reservoir installed at the cold-storage room. In other words, the drinking water in the reservoir 52 is cooled by cool air transferred through the corresponding doors 30 and 40 from the cold-storage room 10 or the freezer. Accordingly, for the rapid cooling of the drinking water contained in the reservoir 52, it is more desirous that the reservoir 52 is located inside the freezer door 40 rather than inside the cold-storage room door 30. Also, the reservoir 52 is substantially varied in an adiabatic material layer 40*a* filled in the freezer door 40. Accordingly, although the cool air of the freezer 20 can be transferred to the reservoir 52, the water is not frozen due to the existence of the adiabatic material layer 40*a*. Simultaneously, since heat of room temperature is transferred to the reservoir through a surface of the door opposite to a surface contacting the freezer 20, e.g., the front surface of the freezer door 40, it is possible that the reservoir 52 always stores cold water. Further, the reservoir 52 is preferably installed in the vicinity of the front surface of the door contacting the outside. This is because the reservoir 52 may be less influenced by the cool air of the freezer 20 and thus freezing of the water in the reservoir 52 can be securely prevented while the stored drinking water is cooled.

In the meanwhile, a constant amount of water stays in the pipe connecting the reservoir 52 and the discharging part 54, e.g., the second pipe 53. In other words, as the second pipe 53 is lengthened, the amount of the water staying in the second pipe 53 increases, so that it becomes difficult to provide fresh water to a user, and sanitary problem may be caused. Resultantly, in order to make the second pipe as short as possible, the reservoir 52 should be installed nearer the discharging part 54 if possible. Here, since the reservoir 52 is placed within the door 40, the reservoir 52 is, as shown in FIG. 3, placed right after the discharging part 54, so that the length of the second pipe 53 becomes substantially shortest. Accordingly, the short second pipe 53 allows a user to be directly supplied with fresh water, and the sanitary problem is also resolved.

As shown in FIG. 3 in more detail, the discharging part 54 includes a cavity formed at the front side of the refrigerator door so as to stably accommodate a container for drinking water, such as a cup, and a nozzle connected to the second pipe 53, for discharging drinking water. And, as aforementioned, in order to shorten the second pipe if possible, the discharging part 54 is installed adjacent to the reservoir 52 at the front side of the freezer door 40. More preferably, in order to minimize the length of the second pipe 53, the discharging part 54 is installed right before the reservoir 52.

In addition, since the second pipe 52 also connects the reservoir 52 and the discharging part 54, it is installed varied in the adiabatic material layer 40*a*. The second pipe 53 is, as shown in FIG. 3, installed adjacent to the front side of the freezer door 50, which is to prevent the water in the second pipe 53 from being frozen by the cool air of the freezer 72.

Figure 1:
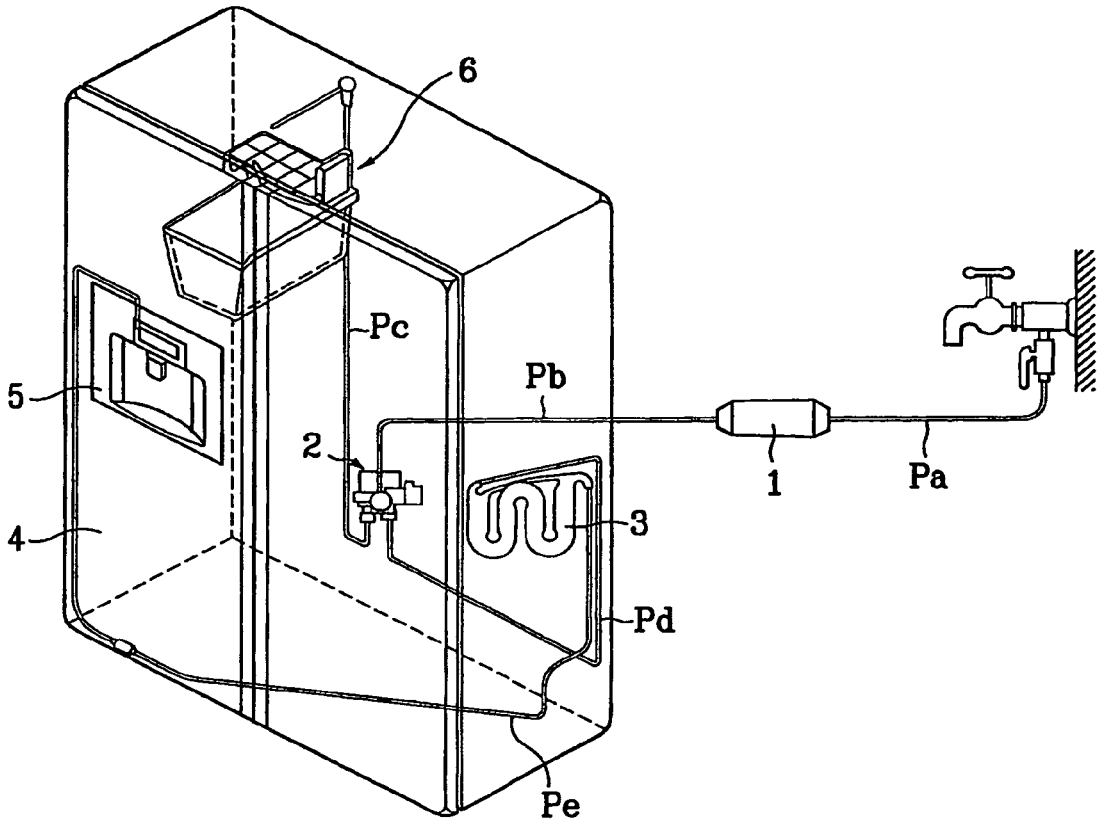
PRIOR ART FIG.1
FIG. 1 is a perspective view of a general refrigerator.

Similarly to the second pipe 53, the first pipe 51 is also partially varied in the adiabatic material layer 40*a* inside the freezer door 40 so as to be connected to the reservoir 52. Also, in order to prevent the water in the first pipe 51 from being frozen, a part of the first pipe 51 is installed adjacent to the front side of the freezer door 40. Meanwhile, in case the reservoir 52 is located within the cold-storage room 10 like the conventional refrigerator (refer to FIG. 1), the first pipe 51 has to have a distant roundabout path inside the refrigerator so as to connect the reservoir 52 and the discharging part 54, so that it is unnecessarily lengthened. However, since the reservoir 52 is located inside the freezer door 40, the first pipe is, as shown in FIG. 2, connected directly to the discharging part 54 from the water supply source, so that the length of the first pipe 51 is shortened. Resultantly, the dispenser of the present invention is more simplified.

Operation of the dispenser for a refrigerator according to the present invention will be now described.

If a user is discharged with water from the dispenser (for instance, by pushing a water discharging button), the drinking water of the water supply source is introduced into the valve 55 via a filtration unit (not shown). The introduced water is branched into two pipes 51 and 56 at the valve 55. The water passing through the first pipe 51 is supplied to the discharging part 54, and the water passing through the second pipe 56 is supplied to the ice machine 60. Here, before the water is supplied through the discharging part 54, a certain amount of water is stored in the reservoir 52, and is properly cooled by the cool air through freezer door 40. Thus, since the water is discharged through the minimized second pipe 53 during supply to the user, the water is in the most fresh and cool status.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

INDUSTRIAL APPLICABILITY

According to the aforementioned invention, the following effects are anticipated.

First, since the reservoir is installed inside the freezer door in the dispenser of the present invention, the inner space of the refrigerator is not occupied unnecessarily. Accordingly, it becomes substantially possible to effectively use the inner space of the refrigerator.

Also, since the passage from the reservoir to the discharging part is very short, it becomes possible to maintain the water discharged from the discharging part at fresh and cool status, so that use of the dispenser becomes convenient.

Further, since the reservoir is located inside the door, an overall extending length of the pipe is substantially shortened. Accordingly, decrease in the number of elements and enhancement in the productivity are anticipated when the present invention is applied to the fabrication of the dispenser and the refrigerator including the dispenser.

What is claimed is:

1. A dispenser for a refrigerator, comprising:

a first pipe connected with a water supply source;

a reservoir installed inside a door of the refrigerator and upwardly connected with the first pipe, for temporarily storing water supplied from the water supply source;

a second pipe connected with a top of the reservoir; and a discharging part installed in the door of the refrigerator and connected with the second pipe, for discharging the water supplied from the reservoir depending on a user's necessity.

2. The dispenser of claim 1, wherein said reservoir is installed inside a door of a freezer.

3. The dispenser of claim 2, wherein said reservoir is buried in an adiabatic material layer disposed within the door of the freezer.

4. The dispenser of claim 3, wherein said reservoir is installed in the vicinity of the front side of the door of the freezer.

5. The dispenser of claim 3, wherein said reservoir is installed in the vicinity of the discharging part.

6. The dispenser of claim 5, wherein said reservoir is installed right after the discharging part.

7. The dispenser of claim 1, wherein said discharging part is installed in a door of a freezer of the refrigerator.

8. The dispenser of claim 7, wherein said discharging part is installed right before said reservoir.

9. The dispenser of claim 1, wherein said second pipe is installed inside a door of a freezer of the refrigerator and is buried in an adiabatic material layer.

10. The dispenser of claim 9, wherein said second pipe is installed in the vicinity of the front side of the door of the freezer.

11. The dispenser of claim 1, wherein said first pipe is partially installed inside a door of a freezer of the refrigerator and is buried in an adiabatic material layer.

12. The dispenser of claim 11, wherein said first pipe is partially installed in the vicinity of the front side of the door of the freezer.

13. A refrigerators comprising:

a freezer and a cold storage room formed inside a main body; and a dispenser including a first pipe connected with a water supply source, a reservoir installed inside a door of the refrigerator and upwardly connected with the first pipe, for temporarily storing water supplied from the water supply source, a second pipe connected with a top of the reservoir and a discharging part installed in the door of the refrigerator and connected with the second pipe, for discharging the water supplied from the reservoir depending on a user's necessity.

14. The refrigerator of claim 13, wherein said reservoir is installed inside a door of a freezer.

15. The refrigerator of claim 14, wherein said reservoir is buried in an adiabatic material layer disposed within the door of the freezer.

16. The refrigerator of claim 15, wherein said reservoir is installed in the vicinity of the front side of the door of the freezer.

17. The refrigerator of claim 15, wherein said reservoir is installed in the vicinity of the discharging part.

18. The refrigerator of claim 17, wherein said reservoir is installed right after the discharging part.

19. The refrigerator of claim 13, wherein said discharging part is installed in a door of a freezer of the refrigerator.

20. The refrigerator of claim 19, wherein said discharging part is installed right before said reservoir.

21. The refrigerator of claim 13, wherein said second pipe is installed inside a door of a freezer of the refrigerator and is buried in an adiabatic material layer.

22. The refrigerator of claim 21, wherein said second pipe is installed in the vicinity of the front side of the door of the freezer.

23. The refrigerator of claim 13, wherein said first pipe is partially installed inside a door of a freezer of the refrigerator and is buried in an adiabatic material layer.

24. The refrigerator of claim 23, wherein said first pipe is partially installed in the vicinity of the front side of the door of the freezer.

* * * * *